US010947681B2

(12) United States Patent
Stelzer et al.

(10) Patent No.: US 10,947,681 B2
(45) Date of Patent: Mar. 16, 2021

(54) PROTECTIVE CONSTRUCTION

(71) Applicant: Trumer Schutzbauten Ges.m.b.H, Oberndorf (AT)

(72) Inventors: Gernot Stelzer, Kuchl (AT); Daniel Jäger, Obertrum (AT)

(73) Assignee: Trumer Schutzbauten Ges.m.b.H, Oberndorf (AT)

( * ) Notice: Subject to any disclaimer, the term of this patent is extended or adjusted under 35 U.S.C. 154(b) by 0 days.

(21) Appl. No.: 16/341,371

(22) PCT Filed: Oct. 10, 2017

(86) PCT No.: PCT/EP2017/075835
§ 371 (c)(1),
(2) Date: Apr. 11, 2019

(87) PCT Pub. No.: WO2018/069335
PCT Pub. Date: Apr. 19, 2018

(65) Prior Publication Data

US 2020/0056337 A1 Feb. 20, 2020

(30) Foreign Application Priority Data

Oct. 14, 2016 (EP) ..... 16193968

(51) Int. Cl.
*E01F 7/04* (2006.01)

(52) U.S. Cl.
CPC ..... *E01F 7/045* (2013.01)

(58) Field of Classification Search
CPC combination set(s) only.
See application file for complete search history.

(56) References Cited

U.S. PATENT DOCUMENTS

| | | | | |
|---|---|---|---|---|
| 2003/0175076 | A1 | 9/2003 | Albritton | |
| 2006/0193688 | A1 | 8/2006 | Albritton | |
| 2014/0374203 | A1* | 12/2014 | Stelzer | E01F 7/045 188/371 |

FOREIGN PATENT DOCUMENTS

| | | | |
|---|---|---|---|
| CH | 527626 | A | 9/1972 |
| DE | 1229341 | B | 11/1966 |
| DE | 3108607 | A1 | 4/1982 |
| DE | 29918625 | U1 | 2/2000 |
| EP | 0709265 | A1 | 5/1996 |
| FR | 2673253 | A1 | 8/1992 |
| WO | 96/13972 | A1 | 5/1996 |

* cited by examiner

*Primary Examiner* — Sean D Andrish
(74) *Attorney, Agent, or Firm* — Kolitch Romano LLP

(57) ABSTRACT

A protective construction, such as a fence for a race track, may include a device for energy dissipation, e.g., in line with a guy wire. In some examples, the energy dissipation device may have a braking profile and a cutting unit having at least one blade that can be pulled through the braking profile along its longitudinal axis.

3 Claims, 4 Drawing Sheets

PROTECTIVE CONSTRUCTION

BACKGROUND

A generic device is known from WO 2009/137951. This known device is embodied as a device for shock absorption in cable constructions, in particular for protective constructions against falling stones, mudslides and snow, and absorbs energy introduced into a tensioned cable based on the fact that an intermediate piece, which is deformable by tensile forces and which is installed in the tensioned cable, has one or multiple longitudinal elements. Here, with its one end, the at least one longitudinal element is connected to a cable end, on the one hand, and, on the other hand, it is guided about a deflection element that is connected to another cable end. Finally, mechanisms are provided by which the formed deflection angle of the longitudinal element(s) is substantially maintained if the intermediate piece is loaded.

For one thing, one disadvantage of this known device is that it entails a relatively high structural effort, which is primarily based on the fact that a bending or deflection of the intermediate piece occurs via the deflection element for the purpose of energy absorption, wherein a special device has to be provided for maintaining the deflection angle, which may consist of two pilot pins, for example. Further tests conducted in the context of this invention have shown that despite the objective of the generic printed document to better define or optimize the shock absorption development there is still a need for further improvement, in particular if high loads are introduced into the cable.

SUMMARY

Thus, it is the objective of the present invention to create a protective construction, in which an at least substantially linear energy absorption of the loads introduced into the cables is ensured.

The objective is achieved through the features of claim 1. The subclaims contain advantageous further developments of the invention.

The advantages of the invention include the fact that the structural design of the device according to the present disclosure can be realized in a simpler manner, since for example no appliances for maintaining a deflection angle are necessary, since the cutting unit can be guided in a linear and thus deflection-free manner through the braking profile or is pulled through it by the cable when a tensile force is applied.

The protective construction according to the present disclosure can be used against rock fall, falling wood, avalanches or the like (for example as a catch fence for car racing tracks).

Such a protective construction usually has a carrier structure which, depending on the installation length, has a plurality of supports that are arranged at a distance to each other and that can be fixated at a slope. A net, which can preferably be provided with a mesh layer, is attached at the supports. For this purpose, a top and a bottom carrying cable are provided. The top carrying cable guides the net in the area of carrier heads of the supports, and the bottom carrying cable guides the net in the area of the support foot. Laterally of the net, the top and bottom carrying cables are attached in the subsoil by way of rock anchors, wherein the energy dissipation devices according to the invention can be provided in this area as well as preferably also in the area of the net. In principle, it is also possible to use only one cable or multiple cables stretching out the net as the carrier structure.

In a particularly preferred embodiment, one or multiple middle cables are present between the top carrying cable and the bottom carrying cable, which can be connected to the net, for example by being a looped through it. Here, the connection can be realized continuously across the entire length of the control structure or can be omitted in the area where the middle cables extend across the carriers of the carrier structure, wherein in that case the looping through, which has been mentioned by way of example, is not realized in this area.

The middle cables extend across the entire length of the control structure and are also fixated in the subsoil laterally of the outermost carriers of the protective construction, wherein here again rock anchors can preferably be provided, in the area of which energy dissipation devices or cable brakes formed corresponding to the principles of the present disclosure may be provided.

BRIEF DESCRIPTION OF THE DRAWINGS

Further details, features and advantages of the invention follow from the following description of exemplary embodiments based on the drawing.

Herein.

DETAILED DESCRIPTION

Figure 1:
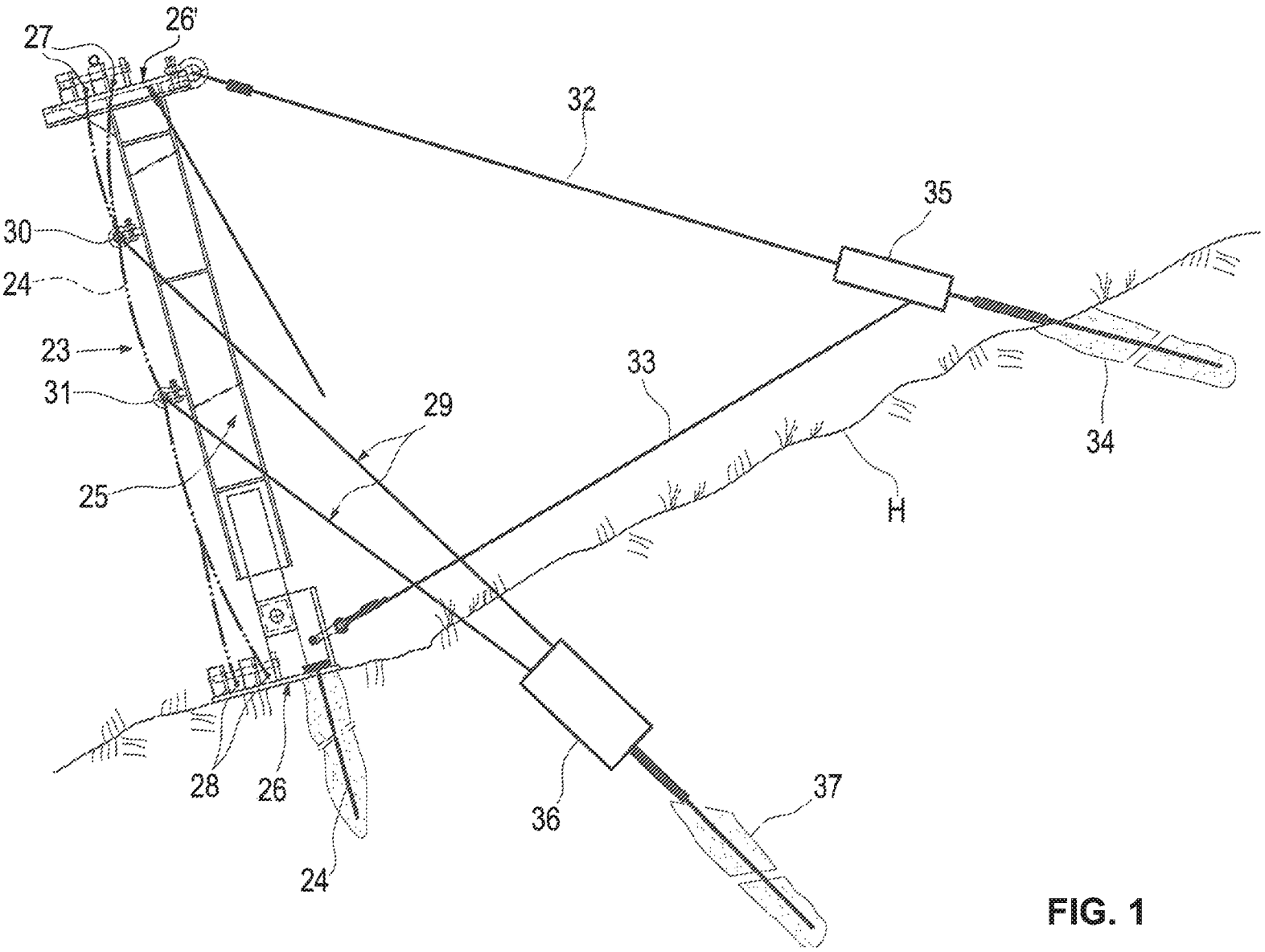
FIG. 1 shows a schematically simplified side view of a protective construction according to the present disclosure.

FIG. 1 shows, in a schematically simplified manner, a protective construction 23 according to the invention, wherein FIG. 1 shows a side view.

The protective construction 23 has a so-called carrier structure which is usually formed by a plurality of supports, which may for example be affixed via rock anchors 24 in the base of a slope. Depending on the length of the control structure of the protective construction 23, a plurality of such carriers is provided, which can be positioned next to each other at the slope H at selectable distances to each other. In principle, it is also possible that only one such carrier or only one cable arrangement is provided.

The protective construction 23 further has a net 24 which is guided via carrying cable arrangement 27 in the area of a carrier head 26 of the carrier 25 that can be seen in FIG. 1, wherein it is possible that the carrying cable arrangement 27 comprises either one top carrying cable or multiple top carrying cables.

In the area of the support foot 26 of the supports 25, a bottom carrying cable arrangement 28 is provided, which again can be comprised of one carrying cable or multiple carrying cables.

In the shown, particularly preferred exemplary case, a middle cable arrangement 29 is provided between the top carrying cable arrangement 27 and the bottom carrying cable arrangement 28. This cable arrangement 29 can have one or multiple middle cables that can be guided at the carrier 25 via guide devices 30 or 31. Here, the guide devices 30 and 31 can for example be embodied as shackles, tube cable guides, or caliper guides.

Further, the embodiment of the protective construction 23 according to FIG. 1 illustrates that a top guy cable 32 and a bottom guy cable 33 are provided. Via an attachment device 34 (rock anchors), the top guy cable 32 holds the carrier head of the carrier 25 in the subsoil of the slope H, while this fixation takes over the bottom guy cable 33 in the lower area (support foot 26) of the carrier 25. As illustrated in FIG. 1, with each of these guy cable arrangements 32, 33, a braking element or an energy dissipation device can be switched in, which is symbolized in FIG. 1 by the block 35 and can be embodied according to the previously explained embodiments of the dissipation device according to the invention.

A corresponding fixation of the top and bottom carrying cables (which is not shown in FIG. 1) as well as of the middle cables can be realized by way of an energy dissipation device 36 (also referred to as an energy absorbing structure or a cable brake) that can also be embodied corresponding to the principles of the present invention, which are explained in the following based on FIGS. 2 to 6. Here, it is possible to switch in a dissipation device 1 in each of the individual cables 27, 28, 29, 32 or 33, or to assign multiple cables (such as e.g. the cables 29 and 32, 33) to such a dissipation device 1.

Figure 2:
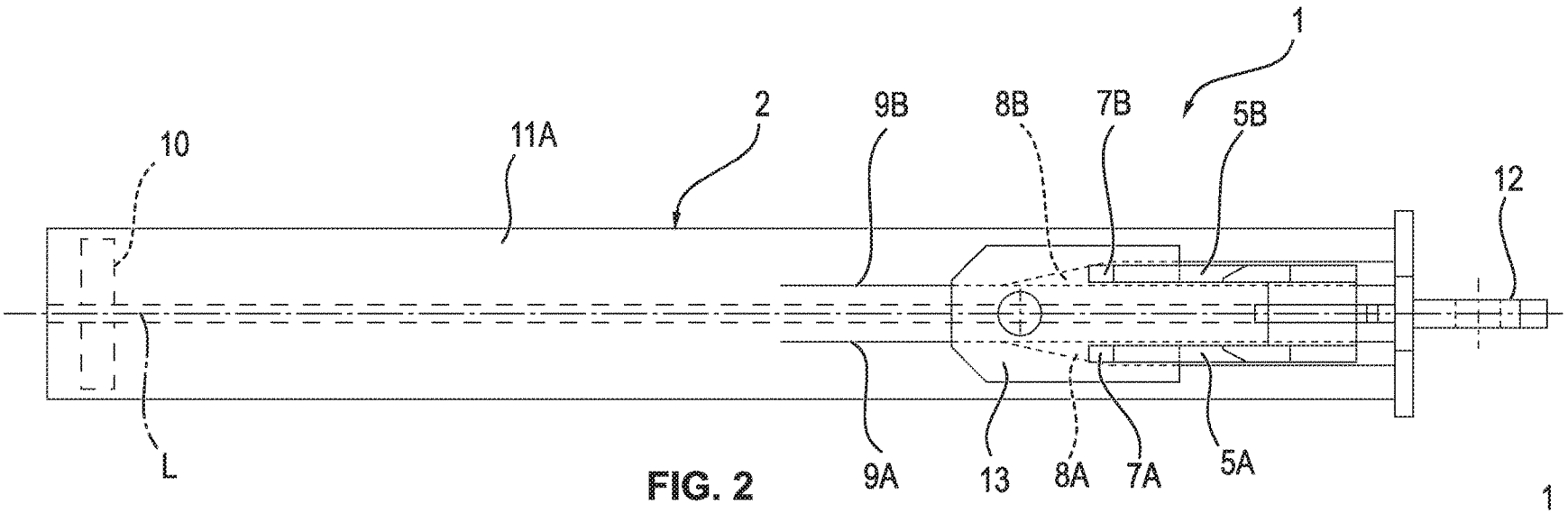
FIG. 2 shows a schematically slightly simplified top view of a device for energy dissipation according to the present disclosure.
Figure 3:
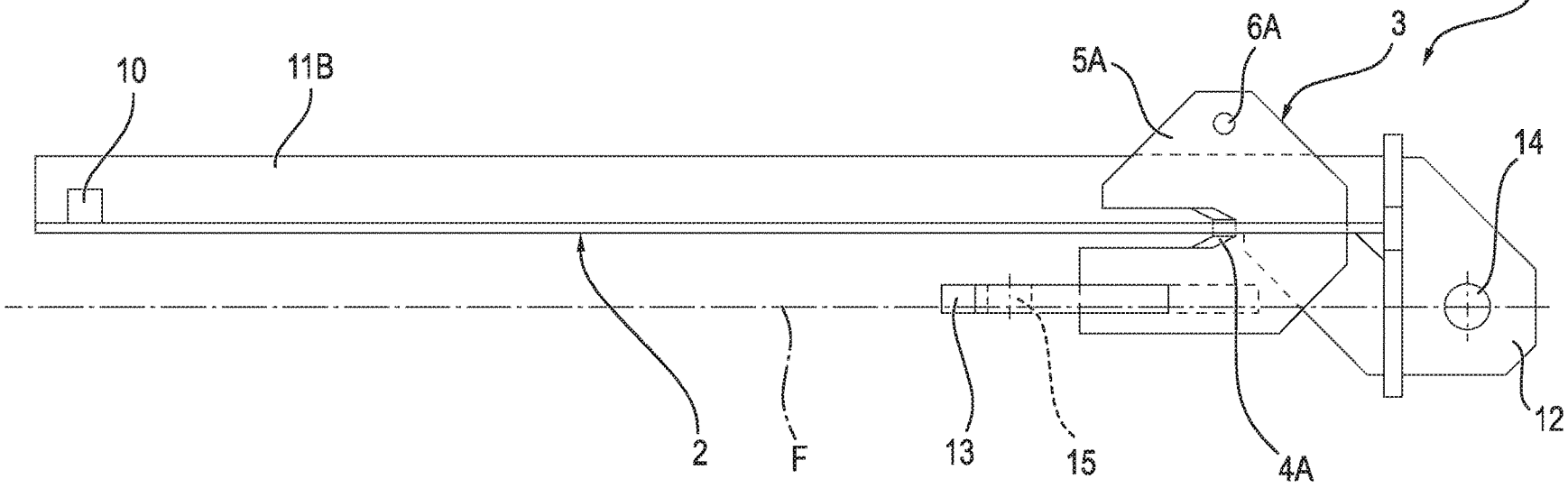
FIG. 3 shows a side view of the device of FIG. 2.

FIGS. 2 and 3 show a first particularly preferred embodiment of a device 1 for energy dissipation (energy dissipation device) according to the invention.

The device 1 has a braking profile 2 which in an exemplary case is constructed of an elongated rectangular sheet-metal strip 11A and a guide web 11B that is centrally welded to the same, and at which an end stop 10 is affixed at one end.

As illustrated in a combined view of FIGS. 2 and 3, a pair of pre-cut gaps for inserting cutting sheets 5A and 5B, which are parts of a cutting unit 3 acting together with the braking profile 2 for creating the energy dissipation, is provided in the sheet-metal strip 11A at the end of the sheet-metal strip 11A that is arranged opposite the end stop 10. The pre-cut gaps 7A, 7B for inserting these cutting sheets 5A and 5B transition into tapering inlet areas 8A or 8B which in turn transition into pre-cut insertion slits 9A and 9B that pass through the entire sheet thickness of the sheet-metal strip 11A.

As can in particular be seen from FIG. 3, the cutting sheet 5A has a cutting edge 4A, just like the cutting sheet 5B that has such a cutting edge, which will be described in more detail based on FIG. 6.

As is further shown in the combined view of FIGS. 2 and 3, the sheet-metal strip 11B is provided with a connecting lug 12 for a cable that is not shown in FIGS. 2 and 3, for which purpose the connecting lug 12 comprises a connecting recess 14 into which e.g. a cable shackle can be inserted.

The cutting unit 3 also has a connecting lug that is indicated by reference number 13 and inside of which a connecting recess 15, into which e.g. a shackle of a cable arrangement can be inserted, is also provided.

Here, FIG. 3 illustrates that the connecting recesses 14 and 15 are arranged in a line of sight F, so that no canting can occur as a result of the cutting unit 3 being pulled through the braking profile 2, so that the cutting process is equalized.

Such a device 1 for energy dissipation can be installed in the protective construction 23, for example at the position of the devices for energy dissipation that are characterized by the reference numbers 35 and 36.

The particular advantage of the embodiment according to FIGS. 2 and 3 is the fact that the energy to be received can be set in a very simple manner by way of a corresponding dimensioning of the sheet-metal strip 11A.

Further resulting are advantages with regard to simple mounting through the pre-cut gaps 7A and 7B into which the cutting sheets 5A and 5B can be inserted in a simple manner. Further, the cutting process is improved by the tapering inlet areas 8A and 8B connecting to the gaps 7A and 7B, as well as the insertion slits 9A and 9B in turn connecting to the former.

As previously explained, in the embodiment according to FIGS. 2 and 3, the braking profile 2 is constructed from a flat sheet-metal strip 11A and the guide web 11B, thus forming a T-profile. Here, the guide web 11B represents an option which, although improving the guiding of the cutting sheets 5A and 5B, does not necessarily have to be provided, so that, according to the invention, the braking profile 2 can also be a flat or planar sheet-metal strip such as the sheet-metal strip 11A.

As the cutting unit 3 is pulled through the braking profile with its blade or its blades 4A, 4B, energy dissipation is realized by the braking profile 2 being split by the blade or the blades 4A, 4B, that is, a part of the braking profile 2 is severed by the cutting unit 3.

Figure 4:
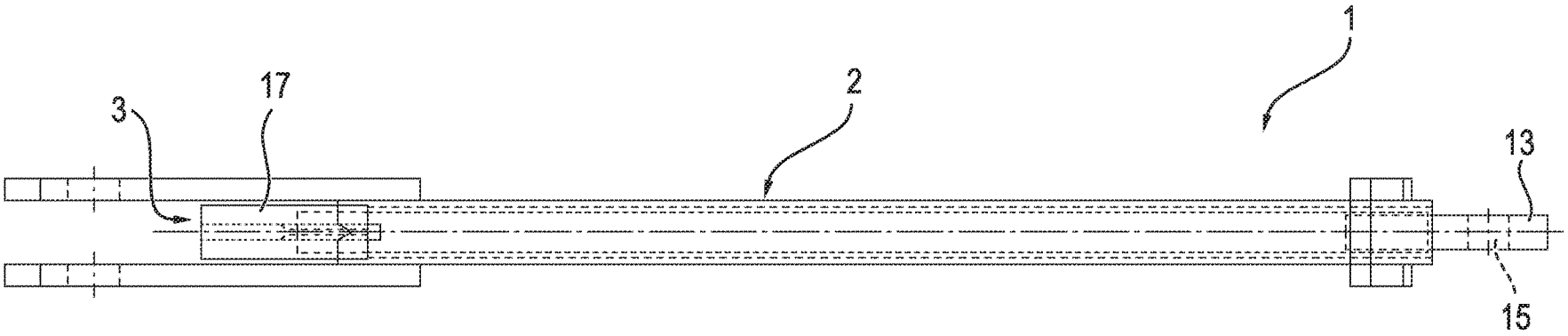
FIG. 4 shows a rendering of a further embodiment of the device for energy dissipation according to the present disclosure corresponding to FIG. 2.
Figure 5:
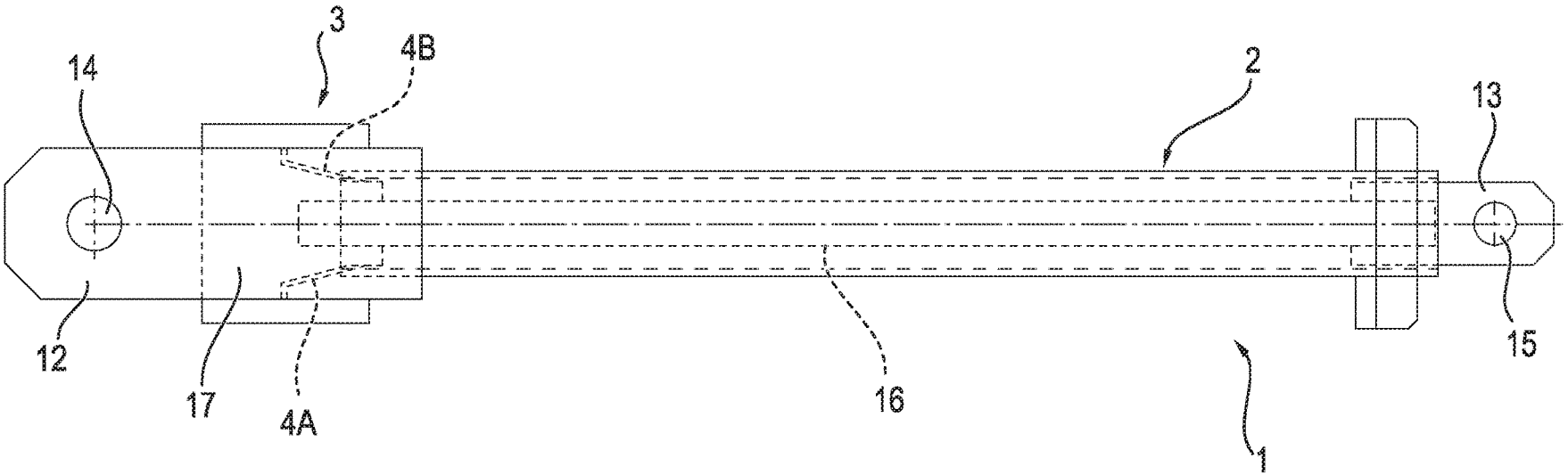
FIG. 5 shows a rendering of the device of FIG. 4 corresponding to FIG. 3.

In contrast to that, in the embodiment of the device 1 for energy dissipation according to FIGS. 4 and 5, a hollow profile is used as a braking profile 2, which may for example be embodied to have a round or angular cross section. In other words, any kind of hollow profile is suitable for the embodiment according to FIGS. 4 and 5.

The cutting unit 3 of the embodiment according to FIGS. 4 and 5 has a cutting sheet 17 with cutting edges 4A and 4B, wherein the cutting sheet 17 is affixed at a tension rod 16 that can be inserted into the hollow braking profile 2, as illustrated in FIGS. 4 and 5. At its free end, the tension rod 16 has a connecting lug 13 with a connecting recess 15 into which a cable shackle of a cable of a protective construction can be inserted.

At the opposite end, the braking profile 2 also has a connecting lug which is indicated by the reference number 12 as it corresponds to the connecting lug 12 of the embodiment according to FIGS. 2 and 3 and correspondingly also has a connecting recess 14 for inserting a cable shackle.

If in the course of a braking process the tension rod 16 including the cutting sheet 17 affixed thereat is pulled with its cutting edges 4A and 4B through the hollow braking profile 2, the cutting edges 4A and 4B cut open the braking profile, whereby an energy dissipation occurs. Here, the cutting profile 17 is embodied as a flat profile, as follows from a combined view of FIGS. 4 and 5.

Figure 6:
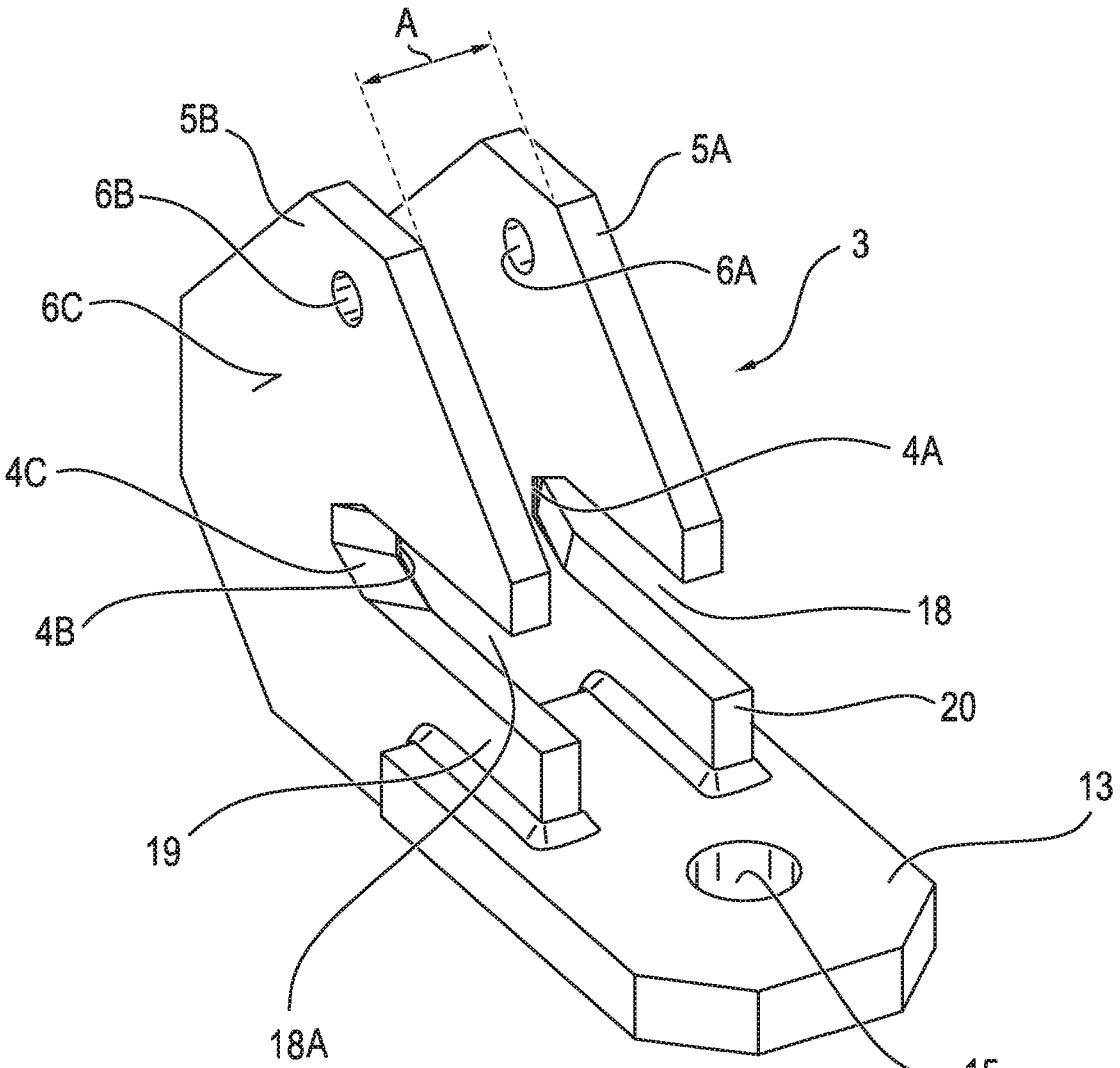
FIG. 6 shows a perspective view of a cutting or gap unit according to the invention for use in the energy dissipation device according to the invention.

In an exemplary case, the cutting sheets or cutting plates 5A and 5B are formed in a trapezoid manner in a top area and aligned in parallel to each other, as illustrated in the perspective rendering of the cutting unit 3 in FIG. 6. Further, the cutting plates 5A and 5B have mounting plates 19 and 20 that are formed in one piece with the trapezoid areas and are connected, preferably welded, to the connecting lug 13, which represents the final mounted state of the cutting unit 3 according to the invention.

As FIG. 6 illustrates, the cutting sheets or cutting plates 5A and 5B take a selectable distance A to each other, since in the state where they are placed onto the braking profile 2, the guide web 11B, if provided, is received inside the resulting intermediate space.

Further, FIG. 6 illustrates that provided between the trapezoid sections of the cutting plates 5A and 5B and the mounting plates 19 and 20 is respectively one insertion slit 18A or 18B, formed in a U-shaped manner and with the cutting edge 4A or 4B respectively being arranged in its base. As can be seen based on the cutting edge 4B, it ends in a guidance chamfer 4C which terminates at an outer wall surface 6C of the cutting plate 5B. A corresponding chamfer is also provided in the cutting edge 4A, but is not visible in FIG. 6. During insertion into the braking profile 2, these chamfers facilitate the sheering off of the severed profile area and thus result in an equalized energy dissipation.

It is further illustrated in FIG. 6 that both cutting plates 5A and 5B have corresponding reception openings 6A and 6B that are arranged in a manner aligned with each other, so that connecting elements, such as for example a connection screw with a corresponding nut, can be inserted through these reception openings 6A and 6B, and can be affixed with corresponding nuts. This connection screw, which is not shown in detail in FIG. 6, improves the guidance of the cutting sheets or cutting plates 5A and 5B during the cutting process, so that it is ensured that the cutting plates 5A and 5B are not sheared off outwards during the cutting process or splitting process.

As follows from the above explanation of the components of the dissipation device 1 according to the invention, the braking profile 2 as well as the cutting unit 3 respectively represent objects that can be traded autonomously and independently of each other, and thus are invention features which are characterized by the previously explained constructional and functional features.

Further, it should be stressed that the blades or cutting edges 4A, 4B can be hardened in both previously described embodiments. Such hardening can preferably be realized by way of gas nitration.

The previously described particularly preferred embodiment of the braking profile 2 for the device 1 for energy dissipation can also be embodied merely as a flat sheet-metal strip having neither pre-cut insertion gaps 7A, 7B nor inlet areas 8A, 8B or insertion slits 9A, 9B. In that case, it is only necessary to provide connecting lugs, such as the connecting lugs 12, 13 that were described by way of example. However, the previously described embodiment of the braking profile 2 with insertion gaps, inlet areas and insertion slits is a particularly preferred embodiment. Here, the inlet areas 8A, 8B can be formed in a tapering or obtusely tapering manner. What is to be understood by "tapering" here is that an inflow area with an acute angle is created, while "obtusely tapering" would mean that the inflow area can be embodied so as to be at least slightly rounded.

In addition to the above written disclosure, the drawn rendering of the invention in FIGS. 1 to 6 is explicitly referred by way of complimenting the disclosure of the invention.

PARTS LIST

1 device for energy dissipation
2 braking profile
3 cutting unit/gap unit
4A, 4B blade/cutting edge
5A, 5B cutting sheet/cutting plate
6A, 6B reception opening for connection screw
7A, 7B pre-cut gap
8A, 8B tapering inlet area
9A, 9B insertion slit
10 end stop
11A sheet-metal strip
11B guide web
12 connecting lug
13 connecting lug
14, 15 connecting recesses
16 tension rod
17 insertion slit
18 insertion slit
19 mounting plate
20 mounting plate
23 protective construction
24 net
25 support
26 support foot
26' support head
27 top carrying cable arrangement
28 bottom carrying cable arrangement
29 middle cable arrangement
30, 31 cable guiding elements (shackles)
32, 33 top or bottom guy cable arrangement
34, 37 attachment elements (rock anchors)
35, 36 device for energy dissipation (cable brake, energy absorption element)
A distance
F line of sight
L longitudinal axis
H slope The following series of paragraphs is presented without limitation to describe additional aspects and features of the disclosure.

A0. Protective construction (23) with a device (1) for energy dissipation, comprising: a braking profile (2); and a cutting unit (3), having at least one blade (4A, 4B) that can be pulled along the longitudinal axis (L) of the braking profile (2) through the same.

A1. Protective construction according to A0, characterized in that the cutting unit (3) has two blades (4A, 4B) that are arranged at a distance to each other.

A2. Protective construction according to A0 or A1, characterized in that the cutting unit (3) has at least one, preferably two, cutting sheets (5A, 5B) that are arranged at a distance to each other and connected to a connecting lug (13), and which comprise the cutting edge (4A) or the cutting edges (4A, 4B).

A3. Protective construction according to any of paragraphs A0 through A2, characterized in that the braking profile (2) is formed as a flat or planar sheet-metal strip (11A).

A4. Protective construction according to A0, characterized in that the sheet-metal strip (11A) is provided with a centrally arranged guide web (11B).

A5. Protective construction according to any of paragraphs A0 through A3, characterized in that the braking profile (2) is formed as a hollow profile, preferably as a round or angular hollow profile.

A6. Protective construction according to A5, characterized in that the cutting unit (3) has a flat cutting profile (17) that is provided with two blades (4A, 4B).

A7. Protective construction according to A6, characterized in that the flat cutting profile (17) is connected to a tension rod (16) that can be inserted into the hollow braking profile (2).

A8. Protective construction according to any of paragraphs A0 through A7, characterized in that the blade (4A, 4B) is formed in a hardened manner, preferably hardened by way of gas nitration.

B0. Device (1) for energy dissipation for a protective construction (23), characterized by at least one of paragraphs A0 through A8.

C0. Cutting unit (3) with at least one blade (4A) that is attached at a cutting sheet (5A).

C1. Cutting unit according to C0, characterized in that two cutting sheets (5A, 5B) arranged at a distance to each other are provided, respectively having a cutting edge (4A and 4B) and being connected, preferably welded, to a connecting lug (13).

C2. Cutting unit according to C0 or C1, characterized in that the cutting sheets (5A, 5B) respectively have a reception opening (6A, 6B) through which a connecting appliance, preferably in the form of a connection screw with a corresponding nut, can be guided.

D0. Braking profile (2) for a device (1) for energy dissipation, having a flat sheet-metal strip (11A) inside of which pre-cut insertion gaps (7A, 7B) are provided, which preferably transition into tapering or obtusely tapering inlet areas (8A, 8B), which in turn preferably transition into corresponding insertion slits (9A, 9B).

D1. Braking profile according to D0, characterized in that the flat sheet-metal strip (11A) is provided with a guide web (11B), wherein an end stop (10) is preferably arranged at the free end of the guide web (11B).

The invention claimed is:

1. A protective construction comprising:

a carrier structure having at least one support held in place by a guy cable, wherein the guy cable is coupled to an anchor in the ground;

an energy dissipation device disposed in line with the guy cable, the energy dissipation device including:

a cutting unit having two cutting sheets arranged at a distance to each other, each cutting sheet having a cutting edge, wherein the cutting unit is coupled to a connecting lug;

a flat sheet-metal strip having two pre-cut insertion gaps which transition into tapering inlet areas, which in turn transition into corresponding insertion slits;

wherein the two pre-cut insertion gaps are configured to receive the cutting edges of the two cutting sheets; and wherein the flat sheet-metal strip is provided with a guide web having an end stop arranged at a free end thereof.

2. The protective construction of claim 1, further comprising a respective reception opening in each cutting sheet, configured to receive therethrough a connecting appliance.

3. The protective construction of claim 2, wherein the connecting appliance comprises a connection screw with a corresponding nut.

* * * * *